US008596372B2

(12) United States Patent
Zhang et al.

(10) Patent No.: US 8,596,372 B2
(45) Date of Patent: Dec. 3, 2013

(54) THERMAL TRIGGERING MECHANISM HAVING A GLASS AMPOULE FOR AEROSOL FIRE EXTINGUISHERS

(75) Inventors: Jiang Zhang, Aschaffenburg (DE); Peter Kloft, Ransbach-Baumbach (DE); Klaus-Jurgen Dell, Neunkirchen (DE); Matthias Agostin, Morlenbach (DE); Stephan Cordes, Lennestadt (DE); Axel Hemmer, Essen (DE); Michael Köller, Siegen (DE); Herbert Weisshaupt, Kreuzau (DE); Alexandra Welp, Bochum (DE)

(73) Assignee: Dynamit Nobel Defence GmbH, Burbach (DE)

( * ) Notice: Subject to any disclaimer, the term of this patent is extended or adjusted under 35 U.S.C. 154(b) by 561 days.

(21) Appl. No.: 12/746,602

(22) PCT Filed: Dec. 4, 2008

(86) PCT No.: PCT/EP2008/066821

§ 371 (c)(1),
(2), (4) Date: Sep. 28, 2010

(87) PCT Pub. No.: WO2009/071635

PCT Pub. Date: Jun. 11, 2009

(65) Prior Publication Data

US 2011/0036600 A1 Feb. 17, 2011

(30) Foreign Application Priority Data

Dec. 7, 2007 (DE) ..... 10 2007 059 358

(51) Int. Cl.
*A62C 13/22* (2006.01)

(52) U.S. Cl.
USPC ..... 169/84; 169/42; 169/57; 102/204; 102/370

(58) Field of Classification Search
USPC ..... 169/12, 57, 42, DIG. 3, DIG. 2, 84; 102/274, 275, 275.11, 205
See application file for complete search history.

(56) References Cited

U.S. PATENT DOCUMENTS

| | | | | |
|---|---|---|---|---|
| 4,202,269 | A * | 5/1980 | Messineo et al. | 102/204 |
| 4,338,861 | A * | 7/1982 | Rhodes et al. | 102/261 |
| 6,491,110 | B2 * | 12/2002 | Gil | 169/43 |
| 2004/0194974 | A1 | 10/2004 | Arnot | |
| 2007/0246229 | A1 | 10/2007 | Gross | |

FOREIGN PATENT DOCUMENTS

EP 1 479 414 A1 11/2004

* cited by examiner

*Primary Examiner* — Len Tran
*Assistant Examiner* — Viet Le
(74) *Attorney, Agent, or Firm* — Antonelli, Terry, Stout & Kraus, LLP.

(57) ABSTRACT

The invention relates to a method for thermally initiated triggering of an aerosol fire extinguisher having a strike pin (6) acted upon by an inner spring (7) and locked in the stand-by state, and after thermal initiation, the lock is removed and the strike pin (6), driven by the force of the inner spring (7), strikes against a mechanical firing cap (1), whereby an initial firing material is released in the firing cap (1), igniting a booster charge (2), the hot conversion gas thereof igniting a pyrotechnic extinguisher charge in the aerosol fire extinguisher. In order that an absolutely reliable initiation takes place under the same conditions throughout the entire service life of the aerosol fire extinguisher, it is proposed that only immediately after the thermal initiation, when the firing pin (6) is still locked, the inner spring (7) is brought to the necessary tension for triggering the firing cap (1), and only after reaching said tension is the lock of the firing pin (6) automatically released.

10 Claims, 2 Drawing Sheets

Figure 1:
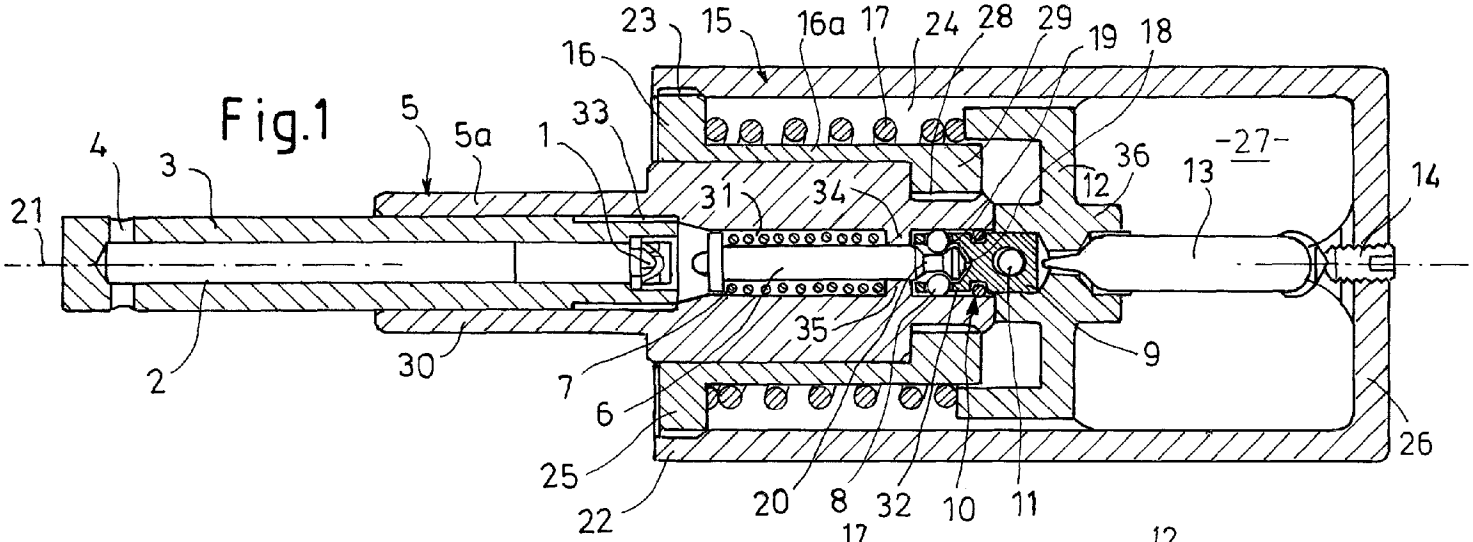

THERMAL TRIGGERING MECHANISM HAVING A GLASS AMPOULE FOR AEROSOL FIRE EXTINGUISHERS

The invention relates to a method for thermally initiated triggering of an aerosol fire extinguisher having a strike pin that is acted upon by an inner spring and is locked in the stand-by state, and after thermal initiation the lock is removed and the strike pin, driven by the force of the inner spring, strikes against a mechanical firing cap, as a result of which an initial firing material in the firing cap is released that ignites a booster charge whose hot conversion gases ignite a pyrotechnic extinguisher charge in the aerosol fire extinguisher. The invention also relates to a thermal triggering mechanism for aerosol fire extinguishers having a strike pin that is guided in a sleeve-shaped body and an inner spring that embraces the strike pin and applies force to the strike pin in the direction of a firing cap and is stayed, on the one hand, on the strike pin and, on the other hand, on the body, and having a locking device that locks the strike pin in its stand-by state and frees it in its free state, and the locking device co-operates with a thermally acting initiating element in such a way that after the initiating element has been triggered the locking device is transferred from its stand-by state into the freeing state.

US 2007/0246229 A1 describes thermally initiated triggering of an aerosol fire extinguisher having a strike pin that is acted upon by an inner spring and is locked in the stand-by state. After thermal initiation the lock is removed and the strike pin, driven by the force of an inner spring, strikes against a mechanical firing cap. As a result, an initial firing material in the firing cap is released that ignites a booster charge whose hot conversion gases ignite a pyrotechnic extinguisher charge in the aerosol fire extinguisher.

Aerosol fire extinguishers often stand in the stand-by state for very many years until they come to be used, that is, the inner spring is always under tension for this long period of time. When used, however, the inner spring must have sufficient spring force even after many years. However, this is often not the case.

The underlying object of the invention is to improve a method for the thermally initiated triggering of an aerosol fire extinguisher in accordance with the preamble of claim 1 in such a way that throughout the period of use of the aerosol fire extinguisher absolutely reliable triggering is effected under always the same conditions. In particular, the tension of the inner spring in the case of use prior to triggering is always to be the same. Furthermore, an aerosol fire extinguisher that meets these demands is to be specified.

In accordance with the invention this object is achieved with regard to the method by means of the features that it is only immediately after the thermal initiation, with the strike pin still locked, that the inner spring is brought to the tension that is necessary in order to trigger the firing cap and it is only after this tension is achieved that the lock of the strike pin is automatically released.

Owing to the fact that it is only immediately after the thermal initiation, with the strike pin still locked, that the inner spring is brought to the tension that is necessary in order to trigger the firing cap and that it is only after this tension is achieved that the lock of the strike pin is automatically released, absolutely reliable triggering is effected under always the same conditions throughout the period of use of the aerosol fire extinguisher. In particular, the tension of the inner spring in the case of use prior to triggering is always the same.

In a preferred development, as a result of displacement of the strike pin in the tensioning direction of the inner spring, without removing the lock of the strike pin, the inner spring is tensioned and the lock is released after the necessary tension has been achieved. As a result, only the strike pin needs to be displaced in order to obtain a tension of the inner spring. This is a purely mechanical step that always leads to the same result even after many years.

A device in accordance with the invention, in particular for carrying out the method that has been mentioned, relates to a thermal triggering mechanism for aerosol fire extinguishers having a strike pin that is guided in a sleeve-shaped body and an inner spring that embraces the strike pin and applies force to the strike pin in the direction of a firing cap and is stayed, on the one hand, on the strike pin and, on the other hand, on the body, and having a locking device that locks the strike pin in its stand-by state and frees it in its free state, and the locking device co-operates with a thermally acting initiating element in such a way that after the initiating element has been triggered the locking device is transferred from its stand-by state into the freeing state.

In accordance with the invention the locking device comprises a piston-like pressure plate to which force is applied in a housing by means of an outer spring, wherein the initiating element in its stand-by state holds the pressure plate so that it is stationary in opposition to the force of the outer spring.

In a preferred embodiment the initiating element is a glass ampoule with an inner liquid that expands upon heating and allows the glass ampoule to burst upon reaching a certain temperature, and then the pressure plate is displaced by the outer spring from its stand-by state into the freeing state. Glass ampoules are ready for use even after many years. They hold the pressure plate in the stand-by state until that time.

In further development of the invention, there is anchored on the pressure plate a cylindrical holding portion which in the stand-by state and during the first movement of the pressure plate in the direction of the freeing state is guided in the body, and the holding portion has a recess with radial openings that extends into the interior from the end face, and the strike pin projects with an annular constriction at its end that is remote from the firing cap into the recess, with the annular constriction being in line with the radial openings, and with balls being arranged in the space between the constriction, the radial openings and the inner wall of the body that anchor the strike pin in the stand-by state and during the first movement of the pressure plate in the direction of the freeing state. What is advantageous in this connection inter alia is that the locking device acts upon the strike pin in line therewith, that is, on its longitudinal axis. The strike pin cannot tilt as a result.

In the free state the radial openings in the holding portion are preferably slid out of the body and the balls fall out of the holding portion, as a result of which the strike pin is no longer locked.

For sealing purposes, in one embodiment there is an O-ring let into the outer periphery of the holding portion that in the stand-by state and during the first movement of the pressure plate rests against the inner wall of the body in the direction of the freeing state.

In a further configuration the body is secured in a sleeve, and the sleeve is screwed into a housing.

In a further development in accordance with the invention there is secured to the body a tube for receiving the firing cap and the booster charge, the latter being arranged in line with the strike pin.

Further features of the invention follow from the figures.

FIG. 1 shows a thermal triggering mechanism for aerosol fire extinguishers in accordance with the invention.

Inserted in a cylindrical housing 15 there is a piston-like pressure plate 12 that can be displaced on the longitudinal axis 21 of the housing 15. A sleeve 16 is screwed into the connection-side end face 22 of the housing 15 by way of a thread 23. The sleeve body 16*a* that extends into the housing 15 has a smaller diameter than the diameter of the housing 15, as a result of which an annular space 24 is located between the sleeve body 16*a* and the housing 15. Inserted in this annular space 24 there is an outer spring 17 that embraces the sleeve body 16*a*. The outer spring 17 is stayed, on the one hand, on the connection-side end 25 of the sleeve 16 and, on the other hand, on the pressure plate 12 so that the pressure plate 12 is pressed in the direction of the end face 26. This end face 26 of the housing 15 is arranged opposite the connection-side end face 22 and is closed. So that the pressure plate 12 is held in the stand-by state, inserted into the housing 15 there is a glass ampoule 13 that is stayed on the pressure plate 12 and on the end face 26. Contained in the glass ampoule 13 there is a liquid that causes the glass ampoule 13 to burst at higher temperatures. So that the glass ampoule 13 can be stayed on the end face 26, a stud screw 14 is turned into the latter, on which the glass ampoule 13 is stayed. A suction body 27 surrounds the glass ampoule 13 in order to take up the liquid in the glass ampoule 13 after the latter has burst.

A cylindrical body 5 is inserted in the interior of the sleeve 16 or the sleeve body 16*a;* in the embodiment shown here it is screwed in by way of a thread 28. This thread 28 is located in the base 29 of the sleeve body 16*a*. Three bores 30, 31, 32, whose longitudinal axes all correspond with the longitudinal axis 21 of the housing 15, are introduced in the interior of the body 5. The connection-side end 5*a* of the body 5 projects out of the housing 15. The bore 30 into which a tube 3 is inserted and screwed by way of a thread 33 is introduced into this end 5*a*. A firing cap 1 is inserted at the end of the tube 3 facing the pressure plate 12. This firing cap 1 is used to ignite a booster charge 2 that is adjacent to the firing cap 1. Located at the end of the tube 3 that is remote from the housing 15 there are discharge holes 4 by way of which the hot conversion gases and particles of the booster charge 2 leave the tube 3 and flow into the fire extinguisher (not shown) and there ignite the pyrotechnic extinguisher charge.

Introduced adjacently to the bore 30 in the interior of the sleeve body 16*a* is the bore 31, whose diameter is reduced in relation to the bore 30. The bore 31 turns into the bore 30 by way of a conical transition region. Introduced adjacently to the bore 31 in the sleeve body 16*a* is the bore 32, whose diameter is equal to that of the bore 31. A guide wall 34 that is reduced in terms of its periphery in relation to the bores is arranged between the bores 31 and 32. A cylindrical passage 35 is introduced in the centre of this guide wall 34 on the longitudinal axis 21. The bore 32 is arranged adjacently to the guide wall 34. Introduced on the outside of the bore 32 on the body 5 is the thread 28 with which the body 5 is screwed into the base 29 of the sleeve body 16*a*.

A strike pin 6 is arranged in the bores 31 and 32 in such a way that it can be displaced on the longitudinal axis 21. This strike pin 6 extends, in the stand-by state, from the space 31 and through the guide wall 34 or the passage 35 as far as into the bore 32. Arranged in the bore 31 there is an inner spring 7 (compression spring) that embraces the strike pin 6. The spring 7 is stayed with its one end on the end portion of the strike pin 6 that faces the firing cap 1 and with its other end on the guide wall 34. In this stand-by state the force or the tension of the inner spring 7 would not be sufficient to initiate the firing cap 1.

A cylindrical holding portion 9 is inserted into the bore 32 in such a way that it can be displaced on the longitudinal axis 21. This holding portion 9 is fixedly connected to the pressure plate 12 by way of a cylindrical pin 11. The pressure plate 12 has for this purpose a central flange 36 into which the end of the holding portion 9 facing the pressure plate 12 engages. The glass ampoule 13, stayed on the flange 36 of the pressure plate 12, engages at the other end of the flange 36. For sealing purposes an O-ring 10, which in the stand-by state rests against the inner wall of the bore 32, is let into the peripheral surface of the holding portion 9.

The co-operation of the strike pin 6 and of the holding portion 9 constitutes the locking and a portion of the triggering mechanism. A recess 18 is located in the holding portion 9 in the lower end of the holding portion 9 facing the strike pin 6. This recess 18 has radial openings 19 that reach as far as the outside of the holding portion 9. The strike pin 6 projects with one of its ends into the recess 18 and at the end projecting into the recess 18 has a constriction 20. In order to lock the strike pin 6 in the holding portion 9, balls 8 are inserted into the recess 18 which, on the one hand, are stayed on the constriction 20 and, on the other hand, project through the radial openings 19 and are stayed on the inner wall of the bore 32. As a result, the strike pin 6 is locked in the recess 18.

The fire extinguisher with an integrated thermal self-triggering mechanism is, for example, fixedly installed in a machine space, in the engine compartment of a car or a sports boat, in a server cabinet, in a storage space or similar. The number and size of the extinguishers are matched to the space where fire is to be extinguished.

In the event of the outbreak of a fire, the glass ampoule 13 that is filled with a special liquid heats up. When a pre-defined temperature (for example 67° C. or 93° C.) is reached, the glass ampoule 13 bursts on account of the expansion of the liquid. Thereupon, first the outer spring 17 presses the pressure plate 12 with the locked strike pin 6 towards the right. The right-hand side edge in the plan view of FIG. 1 is meant by the right.

The pressure plate 12 is fixedly connected to the holding portion 9 by way of a cylindrical pin 11. The holding portion 9 first by way of the balls 8 takes the strike pin 6 along with it towards the right. As a result, the inner spring 7 is pre-tensioned. The inner spring 7 and the outer spring 17 are compression springs.

After the balls 8 have left the inner wall of the body 5 as a consequence of the movement to the right, the balls 8 are pressed radially outwards. As a result, the connection between the holding portion 9 and the strike pin 6 is released. Thereupon, the inner compression spring 7 displaces and accelerates the strike pin 6 towards the left. The strike pin 6 strikes against the mechanical firing cap 1. As a result of the strike, the initial firing material is released in the mechanical firing cap 1. The initial firing material then ignites the booster charge 2. The hot conversion gases and particles flow by way of the holes 4 into the extinguisher (not shown) and there ignite the pyrotechnic extinguisher charge.

The method in accordance with the invention for the thermally initiated triggering of an aerosol fire extinguisher is explained once again in the following with the aid of figures.

As mentioned, FIG. 1 shows the stand-by state, that is, the starting state prior to the initiation. The glass ampoule 13 is intact and holds the pressure plate in a stationary manner in opposition to the force of the outer spring 17. The inner spring 7 is largely without tension. If the lock of the strike pin 6 were to be removed in the stand-by state, the tension of the inner spring 7 would be too low for sufficient acceleration of the strike pin 6. The firing cap 1 would not be initiated.

Figure 2:
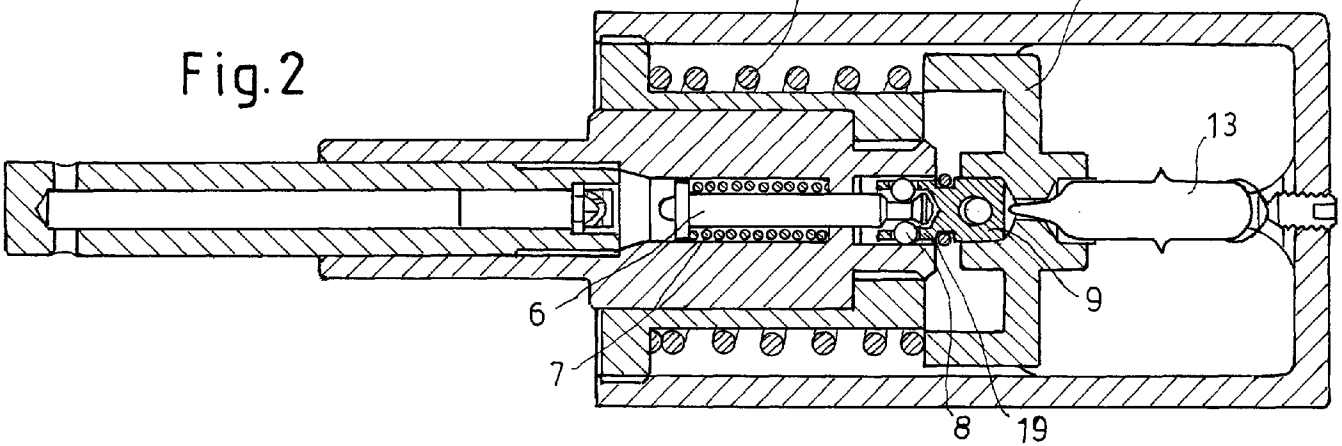

FIG. 2 shows the state shortly after the initiation. The glass ampoule 13 has burst as a result of heating with accompanying volume expansion of the liquid located in the interior. The pressure plate 12 is moved to the right on account of the outer spring 17. The holding portion 9 and the locked strike pin 6 are also moved to the right together with the pressure plate 12. The inner spring 7 starts to become tensioned.

Figure 3:
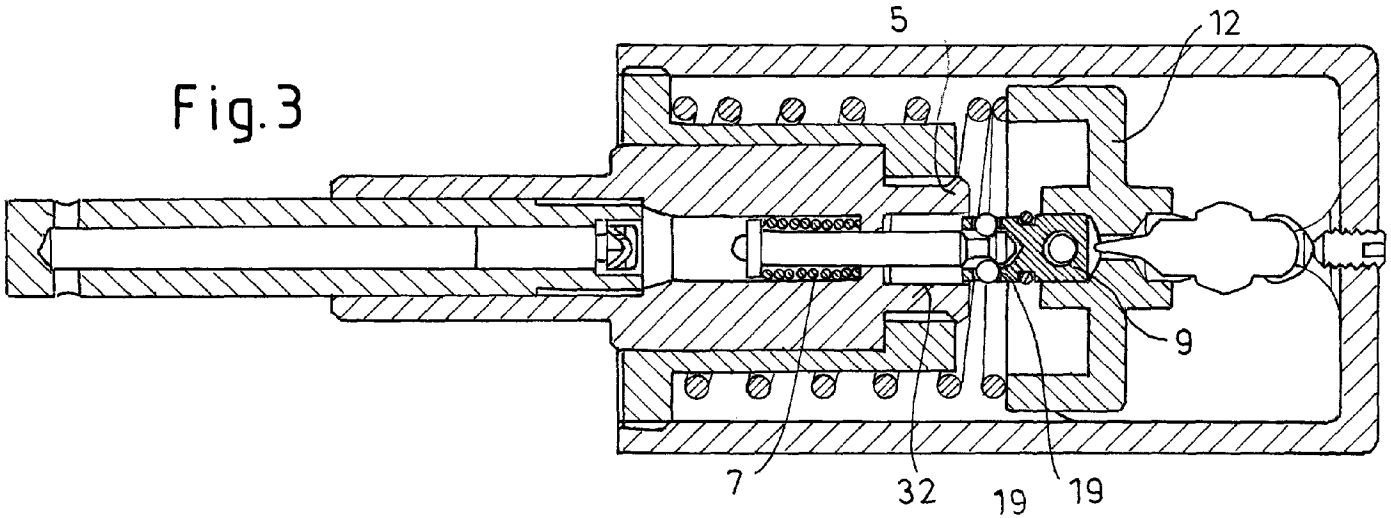

FIG. 3 shows the state somewhat later. The pressure plate 12 has now moved further to the right. Accompanying this movement, the holding portion 9 has almost completely slid out of the body 5, or of the bore 32. The inner spring 7 is now tensioned to the maximum. The radial openings 19 are no longer adjacent to the wall of the bore 32.

Figure 4:
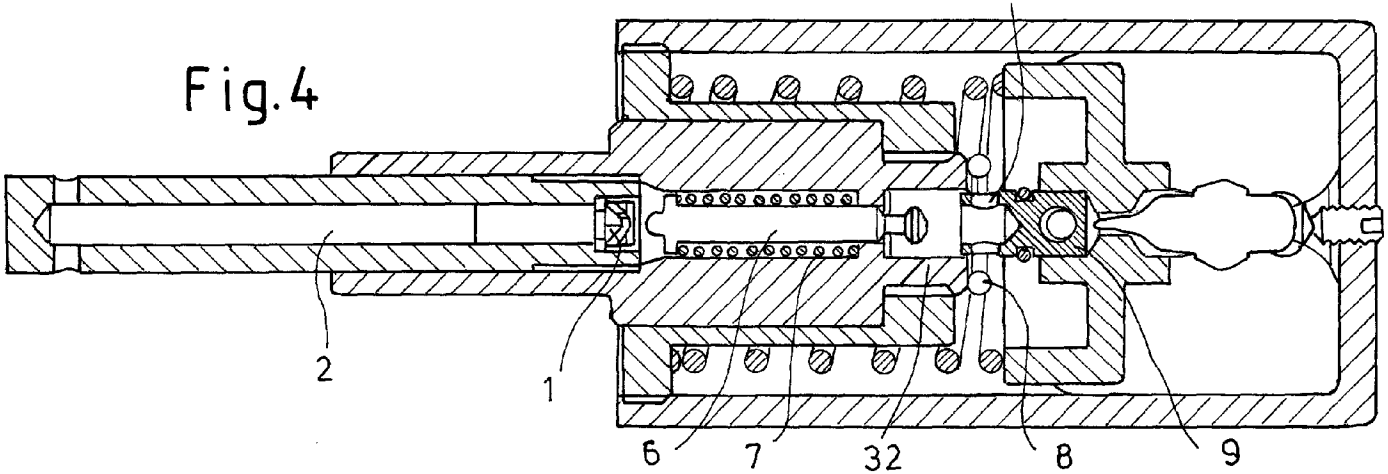

FIG. 4 shows the state again somewhat later. Since the radial openings 19 are no longer adjacent to the wall of the bore 32, the balls 8 fall out of the holding portion 9, that is, out of their inner guide. As a result, the strike pin 6 is no longer locked and is accelerated by the inner spring 7 in the direction of the firing cap 1. What it is not shown further is that the strike pin 6 strikes the firing cap 1 and initiates the latter and as a result the booster charge 2 is ignited which then in turn ignites the pyrotechnic extinguisher charge in the fire extinguisher.

The invention claimed is:

1. A thermal triggering mechanism for aerosol fire extinguishers comprising:

a strike pin that is guided in a sleeve-shaped body;

an inner spring that embraces the strike pin and applies force to the strike pin in the direction of a firing cap, wherein one end of the inner spring is stayed on the strike pin and another end of the inner spring is stayed on the body;

a locking device that locks the strike pin in a stand-by state and frees it in a free state, wherein the locking device comprises a piston-like pressure plate to which force is applied in a housing by means of an outer spring; and a thermally acting initiating element cooperating with the locking device in such a way that after the initiating element has been triggered the locking device is transferred from the stand-by state into the free state, wherein the initiating element in a stand-by state holds the pressure plate so that it is stationary in opposition to the force of the outer spring;

wherein, when the locking device is in the stand-by state, a tension of the inner spring is too low for sufficient acceleration of the strike pin to initiate firing of the firing cap, and, when the locking device is transferred from the stand-by state into the free state, a tension of the inner spring is sufficient for acceleration of the strike pin to the firing cap to initiate firing of the firing cap.

2. The triggering mechanism according to claim 1, wherein the initiating element is a glass ampoule with an inner liquid that expands upon heating and allows the glass ampoule to burst upon reaching a certain temperature, and then allows the pressure plate to be displaced by the outer spring from the stand-by state into the free state.

3. The triggering mechanism according to claim 1, further comprising a cylindrical holding portion anchored on the pressure plate which in the stand-by state and during the first movement of the pressure plate in the direction of the free state is guided in the body, and the holding portion has a recess with radial openings that extends into the interior from an end face, and the strike pin projects with an annular constriction at its end that is remote from the firing cap into the recess, with the annular constriction being in line with the radial openings, and with balls, arranged in the space between the constriction, the radial openings and the inner wall of the body, that anchor the strike pin in the stand-by state and during the first movement of the pressure plate in the direction of the free state.

4. The triggering mechanism according to claim 3, wherein, in the free state, the radial openings in the holding portion are slid out of the body and the balls fall out of the holding portion, as a result of which the strike pin is no longer locked.

5. The triggering mechanism according to claim 3, further comprising an O-ring in an outer periphery of the holding portion that rests against the inner wall of the body in the stand-by state and during the first movement of the pressure plate in the direction of the free state.

6. The triggering mechanism according to claim 1, wherein the body is secured in a sleeve, and the sleeve is screwed into a housing.

7. The triggering mechanism according to claim 1, further comprising a tube secured to the body for receiving a firing cap and a booster charge, the booster charge being arranged in line with the strike pin.

8. The triggering mechanism according to claim 1, further comprising a firing cap arranged in a position adjacent the strike pin such that in the free state the strike pin, driven by the force of the inner spring, can strike against the firing cap.

9. A triggering mechanism for aerosol fire extinguishers comprising:

a strike pin that is guided in a sleeve-shaped body;

an inner spring that embraces the strike pin and applies force to the strike pin in the direction of a firing cap, wherein one end of the inner spring is stayed on the strike in and another end of the inner spring is staved on the body;

a locking device that locks the strike pin in a stand-by state and frees it in a free state, wherein the locking device comprises a piston-like pressure plate to which force is applied in a housing by means of an outer spring;

a thermally acting initiating element cooperating with the locking device in such a way that after the initiating element has been triggered the locking device is transferred from the stand-by state into the free state, wherein the initiating element in a stand-by state holds the pressure plate so that it is stationary in opposition to the force of the outer spring; and a booster charge arranged adjacent the firing cap, the booster charge being configured to be ignited by the firing cap to provide hot conversion gases configured to ignite a pyrotechnic extinguisher charge in an aerosol fire extinguisher.

10. An aerosol fire extinguisher comprising:

a strike pin that is guided in a sleeve-shaped body;

an inner spring that embraces the strike pin and applies force to the strike pin in the direction of a firing cap, wherein one end of the inner spring is stayed on the strike pin and another end of the inner spring is stayed on the body;

a locking device that locks the strike pin in a stand-by state and frees it in a free state, wherein the locking device comprises a piston-like pressure plate to which force is applied in a housing by means of an outer spring;

a thermally acting initiating element cooperating with the locking device in such a way that after the initiating element has been triggered the locking device is transferred from the stand-by state into the free state, wherein the initiating element in a stand-by state holds the pressure plate so that it is stationary in opposition to the force of the outer spring;

a pyrotechnic extinguisher charge; and a booster charge arranged adjacent the firing cap, the booster charge being configured to be ignited by the firing cap to provide hot conversion gases configured to ignite the pyrotechnic extinguisher charge.

* * * * *